US008303774B2

(12) United States Patent
Ruf et al.

(10) Patent No.: US 8,303,774 B2
(45) Date of Patent: Nov. 6, 2012

(54) HEADBOX FOR A MACHINE FOR PRODUCING A FIBROUS WEB

(75) Inventors: Wolfgang Ruf, Herbrechtingen (DE); Konstantin Fenkl, Gerstetten-Heldenfingen (DE); Markus Häussler, Herbrechtingen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/163,271

(22) Filed: Jun. 17, 2011

(65) Prior Publication Data

US 2011/0303381 A1 Dec. 15, 2011

Related U.S. Application Data

(63) Continuation of application No. PCT/EP2009/063836, filed on Oct. 22, 2009.

(30) Foreign Application Priority Data

Dec. 18, 2008 (DE) ..... 10 2008 054 899

(51) Int. Cl.
*D21F 1/18* (2006.01)

(52) U.S. Cl. ..... 162/341

(58) Field of Classification Search ..... 162/341, 162/343

See application file for complete search history.

(56) References Cited

U.S. PATENT DOCUMENTS 3,725,197 A 4/1973 Dahl et al.

FOREIGN PATENT DOCUMENTS

| | | | |
|---|---|---|---|
| DE | 44 16 898 | A1 | 11/1995 |
| DE | 44 16 899 | A1 | 11/1995 |
| DE | 44 16 909 | A1 | 11/1995 |
| DE | 10 2004 033 750 | A1 | 2/2006 |
| EP | 0683266 | A1 | 11/1995 |

OTHER PUBLICATIONS

International Search Report for serial No. PCT/EP2009/063836, dated Jan. 29, 2010. (4 pages).

*Primary Examiner* — Mark Halpern
(74) *Attorney, Agent, or Firm* — Taylor IP, P.C.

(57) ABSTRACT

A headbox includes a feed device for feeding at least one fiber suspension, a perforated distribution pipe plate arranged immediately downstream thereof and having a plurality of channels arranged in lines and columns and an intermediate channel arranged downstream thereof extending over the width of the headbox and having a plurality of apparatuses for dosing a fluid in partial fluid streams to the at least one fiber suspension in an adjustable/controlled manner. The apparatuses are spaced apart from each other in the width direction of the headbox and the individual apparatuses include a plurality of dosing channels having respective dosing channel openings on the outlet side and a dosing channel length, arriving at different levels and being connected to a common supply channel. The headbox further includes a downstream turbulence generator having a plurality of flow channels arranged in lines and columns and a headbox nozzle which is directly contiguous to the turbulence generator and which has a nozzle gap. At least some sections of the channels of the perforated distribution pipe plate have a diffuser and the perforated distribution pipe plate has a length which is $\geqq 0.5\cdot\sqrt{\text{partition}}$ area the partition area being the surface of the downstream perforated distribution pipe plate divided by the total number of the channels of the perforated distribution pipe plate.

26 Claims, 2 Drawing Sheets

HEADBOX FOR A MACHINE FOR PRODUCING A FIBROUS WEB

CROSS REFERENCE TO RELATED APPLICATIONS

This is a continuation of PCT application No. PCT/EP2009/063836, entitled "HEADBOX FOR A MACHINE FOR PRODUCING A FIBROUS WEB", filed Oct. 22, 2009, which is incorporated herein by reference.

BACKGROUND OF THE INVENTION

1. Field of the Invention

The present invention relates to a headbox for a machine or producing a fibrous web, in particular a paper or cardboard web, from at least one fibrous stock suspension.

2. Description of the Related Art

German disclosure document DE 44 16 898 A1 describes a headbox for a paper machine including a feed device for a stock suspension comprising a guiding element with a plurality of channels; upstream from the guiding element is a mixing chamber with several infeed devices which are distributed over the headbox for a fluid which is to be added to the stock suspension and which differs in its characteristics from the stock suspension; and a nozzle chamber forming an outlet opening for the stock suspension, located immediately downstream from the guiding element. The feed devices for the fluid which is to be added extend essentially vertically in the mixing chamber and comprise several dosing openings located on top of each other.

German disclosure document DE 44 16 899 A1 describes a headbox for a paper machine including a feed device for the stock suspension, with a first guiding element comprising a plurality of channels, a second guiding element comprising a plurality of channels, an intermediate mixing chamber, a contiguous nozzle chamber forming an outlet opening for the stock suspension, and several feed lines distributed over the headbox for the fluid which is to be added. The majority of the channels of the guiding elements are positioned and dimensioned so that the outlet opening of the upstream guiding element is not aligned with a confluence into the downstream guiding element. The feed lines for the fluid which is to be added are equipped with dosing openings, the majority of which align respectively with a confluence into the downstream guiding element.

In addition, German disclosure document DE 44 16 909 A1 describes a headbox for a paper machine with a feed device for the stock suspension and a downstream contiguous guiding element equipped with a plurality of channels. Located downstream from there is a mixing chamber extending across the width of the headbox with several separation walls distributed across the headbox and extending essentially in a flow direction, as well as feed devices for a fluid which is to be added, distributed in a cross direction of the headbox and which are equipped with dosing openings. Downstream is an additional guiding element equipped with a plurality of channels and adjacent to it, one nozzle chamber forming an outlet opening for the stock suspension.

The feed devices for at least one fluid which is to be added extend into the mixing chamber and the sectional area which is formed in the mixing chamber by the separation walls begins in the region of the dosing openings from where it extends essentially in a flow direction to the second guiding element.

The headboxes described in the three documents include perforated distribution pipe plates having relatively long lengths. Due to relatively strong fluid frictions, great flow speeds and similar conditions, these long lengths cause large pressure losses in the fibrous stock suspension which are disadvantageous for the operating stability and the desired compact construction of a respective headbox. In addition, the known perforated distribution pipe plates, whether they are in the embodiment of perforated plates or tube banks, are very cost intensive in their production.

In a headbox with a feed device in the embodiment of a cross-distributor the primary function of the perforated distributor pipe plate of the headbox is to divert the fibrous stock suspension, which is delivered in the cross machine direction, to flow into the longitudinal machine direction. The perforated distributor pipe plate is essentially comparable to a "short" tube bank and it also must ensure a uniform volume flow, especially a longitudinal volume flow over the machine width, as well as effect emergence of the fibrous stock suspension flow from the distributor pipe plate to be as aligned as possible, especially longitudinally aligned.

The homogenous distribution of the volume flow of the fibrous stock suspension over the machine width is determined by the pressure loss in the perforated distribution pipe plate. In addition, acceleration of the fibrous stock suspension into the channels of the perforated distribution pipe plate should occur at a ratio of approximately ½ to ⅓. Under these conditions the tendency toward contamination and the associated stagnation point problem on the infeed side of the perforated distribution pipe plate which is known to the expert is herewith avoided.

What is needed in the art is an improved headbox that provides a trouble free operation of the headbox, even with a low pressure loss in at least one fibrous stock suspension. In addition, a process technologically sufficient operational stability across an expanded operational area with an even more compact construction should also be achieved.

SUMMARY OF THE INVENTION

The present invention provides a headbox including a feed device feeding at least one fibrous stock suspension, a perforated distribution pipe plate arranged immediately downstream thereof and having a plurality of channels arranged in rows and columns, an intermediate channel arranged downstream thereof and extending over the width of the headbox and having a plurality of apparatuses for dosing fluid in partial fluid streams into the at least one fibrous stock suspension in an adjustable/controllable manner. The apparatuses are spaced apart from each other in the width direction of the headbox. The individual apparatuses include a plurality of dosing channels having a respective dosing channel opening and discharging at different levels and connected to a common supply channel. The headbox further includes a downstream turbulence generator having a plurality of flow channels arranged in rows and columns and a headbox nozzle which is directly contiguous to the turbulence generator and which has a nozzle gap. The headbox according to the present invention is configured such that a plurality, for example all, channels of the perforated distribution pipe plate arranged in rows and columns include a diffuser, at least in some areas and that the perforated distributor pipe plate has a length which is $\geqq 0.5\cdot\sqrt{\text{partition}}$ area whereby the partition area is the ratio of the downstream total area of the perforated distribution pipe plate and the total number of channels of the perforated distribution pipe plate, arranged in rows and in columns.

The headbox according to the present invention permits the construction and operation of a compact headbox with a clearly reduced pressure loss in the area of the perforated distributor pipe plate in contrast to the current state of the art so that it provides a process which is technologically sufficient and operationally stable headbox even over an expanded operational area. In addition the inflowing speed of the fibrous stock suspension into the intermediate channel of the headbox is reduced in a desirable way by at least one diffuser. Also, in order to be able to design the perforated distributor pipe plate with a shorter length at a lower pressure loss, the partition area must be small in order to control the diversion effects as well as the hydraulic function of a diffuser in a flow cross section at a short length. The length of the perforated distributor pipe plate however continues to represent a sufficient "guide length", so that undesirable cross components to the machine direction can be completely avoided in the fibrous stock suspension emerging from the perforated distribution pipe plate.

In addition, at least one separation element, for example a lamella, may be provided in the headbox nozzle of the headbox of the present invention. In the event that several separating elements, for example lamellas, are arranged in the headbox nozzle of the headbox, different lengths and possibly also different properties such as surface profiles may occur.

In a first embodiment of the headbox of the present invention, the partition area of the perforated distributor pipe plate assumes a value in the range of ≦4,000 square millimeters ($mm^2$), for example ≦2,500 $mm^2$, or 200 to 1,000 $mm^2$. These value ranges contribute substantially, to a compact construction of the headbox.

Moreover, the perforated distributor pipe plate may have an open area of ≧30%, for example ≧40%, or ≧50%, whereby the open area of the perforated distributor pipe plate is the ratio of the total downstream total area of the channels of the perforated distributor pipe plate arranged in rows and columns and the downstream total area of the perforated distributor pipe plate. These value ranges provide the advantage of a slow inflow of the fibrous stock suspension into the intermediate channel. The desired volume flow constancy should flow at an as low a flow dynamic as possible into the intermediate channel, or respectively onto the apparatuses for dosing of fluid and to thereby keep the transition from dynamic into pressure as low as possible. The fibrous stock suspension flow is as "filled" as possible—in other words with the largest possible channels—through the perforated distributor pipe plate.

The individual channel of the perforated distributor pipe plate may have a round channel cross section with a predefined channel diameter. The middle channel diameter of the individual channel of the perforated distributor pipe plate and the length of the perforated distributor pipe plate are, for example, at a ratio of 1:2 to 1:10, 1:3 to 1:8, or 1:4 to 1:5. These value ranges provide improved operating stability of the headbox in a possibly expanded operational window.

The diffuser formed in the individual channel of the perforated distributor pipe plate can have at least one rapid expansion, for example a step expansion and/or at least in some areas a continuous expansion, for example a cone having a cone angle of ≦30°. Also the diffuser formed in the individual channel of the perforated distributor pipe plate may have at least two of the previously described expansions. These designs contribute substantially to the desired or respectively necessary low inflow speed of the fibrous suspension into the intermediate channel of the headbox and to an advantageous pressure recovery.

Also, the at least one fibrous stock suspension which is supplied to the feed device can be fed exclusively to the channels of the perforated distribution pipe plate arranged adjacent downstream. A headbox without recirculation of the fibrous stock suspension can herewith be realized and the volume of fibrous stock suspension on the edge varies substantially less.

Under flow technical aspects the feed device and the channels of the perforated distribution pipe plate may be dimensioned so that the flow speed of the at least one fibrous stock suspension in the feed device and the medium flow speed of the at least one fibrous stock suspension in the channels of the perforated distribution pipe plate is in a ratio of approximately 1:2 to 1:3.

With regard to a compact construction of the headbox, it is also possible for the perforated distributor pipe plate and the intermediate channel to have a total length of 500 mm maximum, for example 350 mm, or 250 mm.

The respective apparatuses for adjustable/controllable metered addition of fluid in partial fluid streams into the at least one fibrous stock suspension may include a dosing sword as described and illustrated in the German patent application (Applicant File: HPA 14265 DE and Applicant-Title: "MJ II-DoS-TE-Geometry") with the same application date as the current patent application. The relating disclosure content is herewith made subject matter of the current description.

The fluid may consist of water, for example clarified water, or of a fibrous stock suspension, such as white water, whose concentration is different than the average concentration of the at least one fibrous stock suspension in the headbox. These types of fluids have already proven themselves well in similar applications.

The inventive headbox is extremely well suited for utilization in a machine for the production of a fibrous web, especially a paper or cardboard web. The fibrous web produced in the machine with at least one inventive headbox possesses outstanding properties throughout, since among other advantages, control of its fiber orientation cross profile, as well as its base weight cross profile, is possible.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
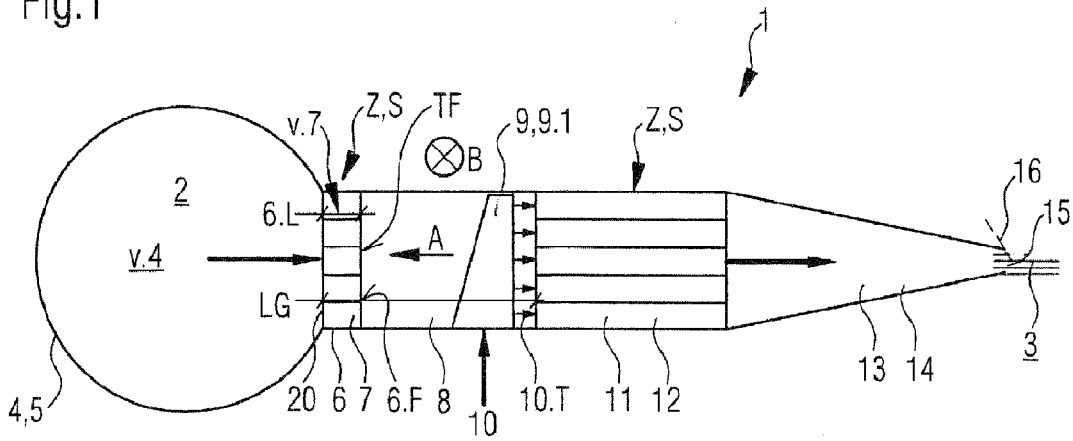
FIG. 1 is a vertical longitudinal sectional view of an embodiment of a headbox for a machine to produce a fibrous web from at least one fibrous stock suspension according to the present invention.

Referring now to the drawings, and more particularly to FIG. 1, there is shown a vertical longitudinal sectional view of an exemplary embodiment of headbox 1 for a machine for producing fibrous web 3 from fibrous stock suspension 2. Illustrated headbox 1 can also be designed as, a multi-layer headbox utilizing at least two different fibrous stock suspensions to produce fibrous web 3. Fibrous web 3 can be a paper, cardboard or tissue web.

Headbox 1 includes one feed device 4 in the embodiment, for example, of cross distribution pipe 5, or a circular distributor (not illustrated here) with a multitude of tubes, feeding one fibrous stock suspension 2.

Figure 2:
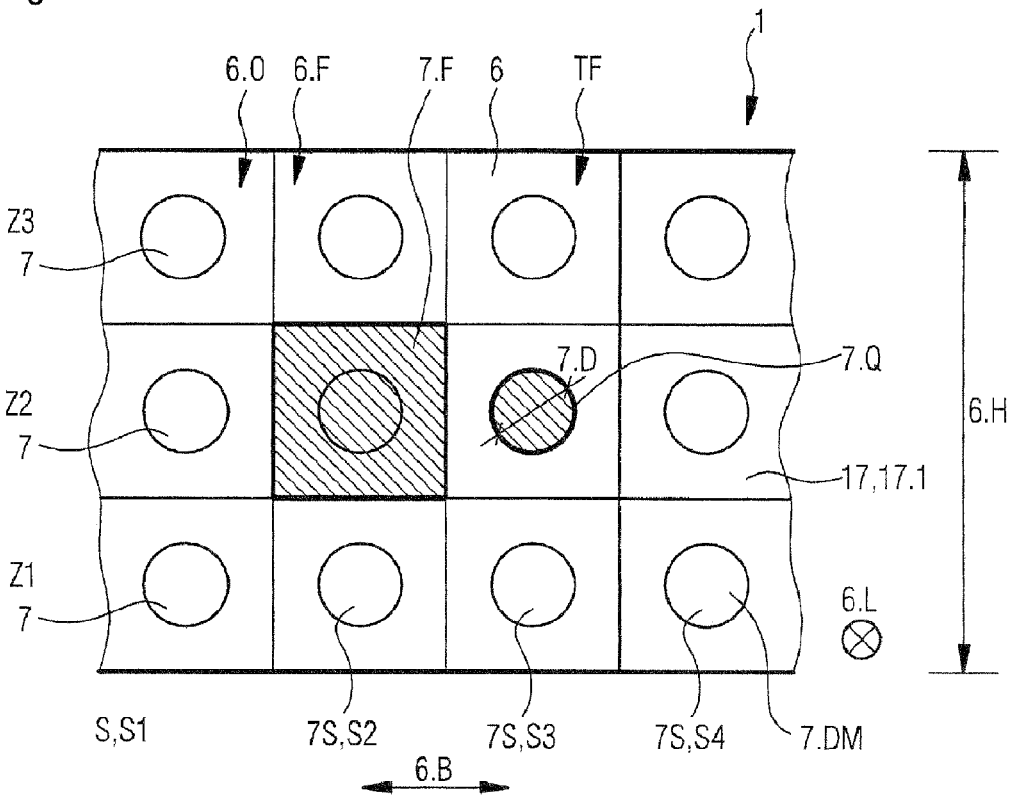
FIG. 2 is a partial view of the headbox illustrated in FIG. 1 to produce a fibrous web from at least one fibrous stock suspension.

Perforated distribution pipe plate 6, which is equipped with a plurality of channels 7 which are arranged in rows Z and columns S, is located downstream adjacent to feed device 4 (compare FIG. 2). Again located adjacent downstream from perforated distribution pipe plate 6 is intermediate channel 8, extending across width B (arrow) of headbox 1, which is equipped with several apparatuses 9 for adjustable/controllable dosing of fluid 10 (arrow) in partial fluid streams 10.T (arrows) into fibrous stock suspension 2, the apparatuses being spaced apart from each other in the width direction of headbox 1. The individual apparatuses 9 for the adjustable/controllable dosing respectively include several dosing channels 21 having respective dosing channel openings 21.1, discharging at different levels and connected to common supply channel 22 (compare FIG. 4). Turbulence generator 13 having a plurality of flow channels 12 arranged in rows Z and column S is located downstream from intermediate channel 8. During operation of headbox 1, fibrous stock suspension 2 is divided into partial fibrous stock suspension streams in turbulence generator 11 and, after emerging from the turbulence generator, is brought together again in machine-wide chamber 13 in the embodiment of headbox nozzle 14 including nozzle gap 15 in order to enable formation of machine-wide fibrous web 3. Flow channels 12 are in the embodiment of, for example, thin-walled turbulence pipes and/or turbulence pipe inserts with at least partially constant, at least partially divergent, at least partially convergent and/or stepped cross sectional surfaces. A separating element (not explicitly illustrated), for example a lamella, may also be provided in headbox nozzle 14. If a multitude of separating elements, such as lamellas are provided in headbox nozzle 14, they can have different lengths and possibly also different properties, such as surface profiles, etc.

As indicated by broken lines, on its outlet side, headbox nozzle 14 may be equipped with aperture 16, at least on one side which is indicated by broken lines.

Figure 3:
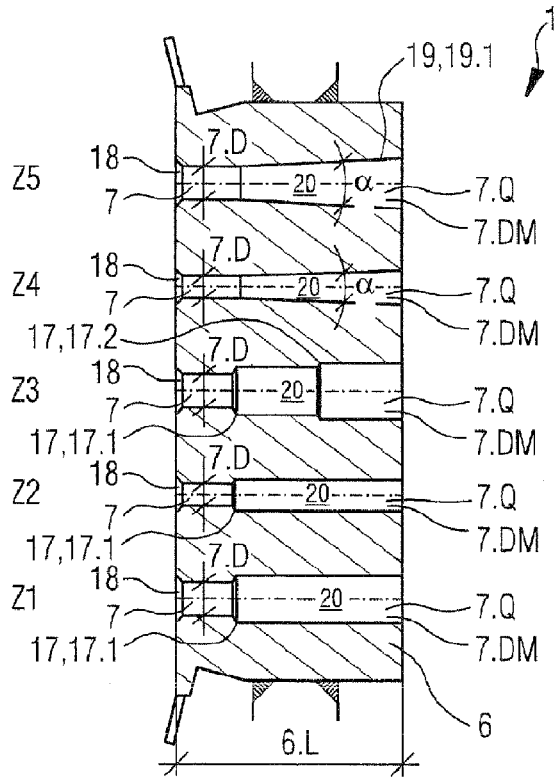
FIG. 3 is a vertical longitudinal sectional view of a perforated distributor pipe plate of a headbox for a machine to produce a fibrous web from at least one fibrous stock suspension according to the present invention, the headbox having different channel cross sections.

Channels 7 arranged in the rows Z and columns S of perforated distribution pipe plate 6 include diffuser 20, at least in some areas (compare FIG. 3). Perforated distributor pipe plate 6 has a length 6.L which is $\geqq 0.5\cdot\sqrt{\text{partition}}$ area whereby partition area TF is the ratio of downstream total area 6.F of perforated distribution pipe plate 6 and the total number of channels 7 arranged in rows Z and in columns S of perforated distribution pipe plate 6. Downstream total area 6.F of perforated distribution pipe plate 6 is hereby downstream width 6.B (double arrow) of perforated distribution pipe plate 6 multiplied by the downstream height 6.H of perforated distribution pipe plate 6 (compare FIG. 2).

In addition, perforated distributor pipe plate 6 and intermediate channel 8 have a total length of 500 maximum, for example 350 mm maximum, or 250 mm maximum. Feed device 4 and channels 7 of perforated distribution pipe plate 6 may be dimensioned so that flow speed v.4 of fibrous stock suspension 2 in feed device 4 and medium flow speed v.7 of fibrous stock suspension 2 in channels 7 of perforated distribution pipe plate 6 are in a ratio of 1:2 to 1:3.

Referring now to FIG. 2, there is shown a partial view of headbox 1 illustrated in FIG. 1 for a machine to produce a fibrous web from at least one fibrous stock suspension according to arrow A. Perforated distribution pipe plate 6 is provided with three rows Z1, Z2, Z3 of channels 7 and several columns of channels 7, whereby however only four columns S1 through S4 are illustrated at channels 7.

Partition area TF of perforated distributor pipe plate 6, in other words the ratio of downstream total area 6.F of perforated distributor pipe plate 6 and the total number channels 7 of perforated distributor pipe plate arranged in rows Z1, Z2, Z3, and in columns S assumes a value in the range of $\leqq$4,000 mm$^2$, for example $\leqq$2,500 mm$^2$, or 200 to 1,000 mm$^2$. Perforated distributor pipe plate 6 itself has open area 6.O of $\geqq$30%, for example $\geqq$40%, or $\geqq$50%, whereby open area 6.O of perforated distributor pipe plate 6 is the ratio of downstream total area 7.F of channels 7 of perforated distributor pipe plate, arranged in rows Z1, Z2, Z3, and in columns S—indicated only for one flow channel 7—and downstream total area 6.F of perforated distributor pipe plate 6. As a rule, downstream total area 6.F of perforated distributor pipe plate 6 is the same as the upstream total inlet area of the intermediate chamber of the headbox.

Moreover, individual channel 7 of perforated distribution pipe plate 6 at least initially has round channel cross section 7.Q with channel diameter 7.D. The illustrated channels 7 of perforated distribution pipe plate 6 have rapid expansion 17, for example step expansion 17.1, from the respective initial round channel cross section 7.Q to a final rectangular, for example square channel cross section 7.Q. Middle channel diameter 7.DM of channel 7 of perforated distribution pipe plate 6 and length 6.L (arrow) of perforated distribution pipe plate 6 are in a ratio of 1:2 to 1:10, for example 1:3 to 1:8, or 1:4 to 1:5.

Referring now to FIG. 3, there is shown a vertical longitudinal sectional view of perforated distribution pipe plate 6 of inventive headbox 1 for a machine to produce a fibrous web from at least one fibrous stock suspension having different cross sections 7.Q. Perforated distribution pipe plate 6 has five rows Z1 to Z5 of channels 7 and a multitude of columns S of channels 7. All channels 7 have round channel cross section 7.Q, however in different forms and embodiments. Moreover, all channels 7 are also provided on the inlet side with inlet chamfer 18.

Channels 7 of two upper rows Z4, Z5 initially have a constant channel cross section 7.Q which lastly experiences continuous expansion 19, for example cone 19.1 with cone angle $\alpha$ of $\leqq$30°. Channels 7 of middle row Z3 have again initially a constant channel cross section 7.Q which lastly experience two rapid expansions 17, for example step expansions 17.1, 17.2. Channels 7 of the two lower rows Z1, Z2 have again initially constant channel cross section 7.Q which lastly experience only one rapid expansion 17, for example one step expansion 17.1.

Each individual channel 7 of perforated distribution pipe plate 6 initially has round channel cross section 7.Q with channel diameter 7.D and lastly forms at least one diffuser 30 based on at least one expansion 17, 19. Middle channel diameter 7.DM of channel 7 of perforated distribution pipe plate 6 and length 6.L of perforated distribution pipe plate 6 have a ratio of 1:2 to 1:10, for example 1:3 to 1:8, or 1:4 to 1:5.

Figure 4:
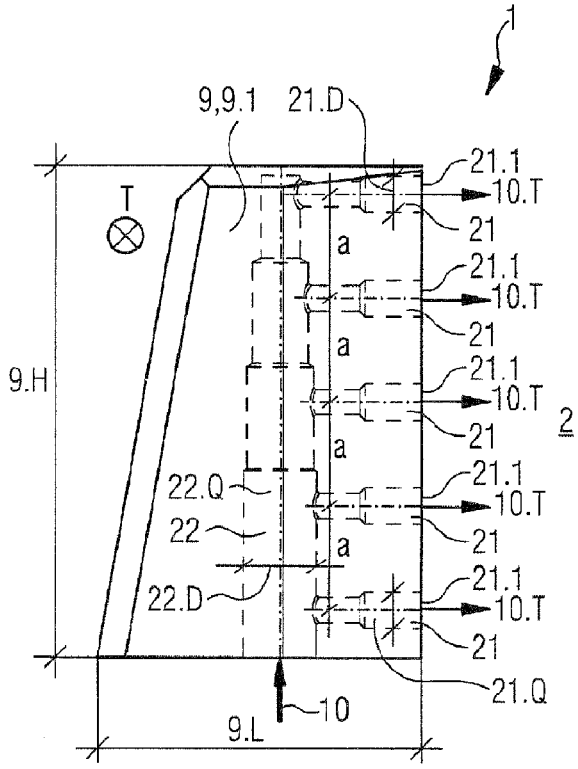
FIG. 4 is a schematic side view of an apparatus for the adjustable/controllable dosing of a fluid in the headbox illustrated in FIG. 1 for a machine to produce a fibrous web from at least one fibrous stock suspension.

Referring now to FIG. 4, there is shown a schematic side view of apparatus 9 for adjustable/controllable dosing of fluid 10 (arrow) of headbox 1 illustrated in FIG. 1 in a machine to produce a fibrous web from at least one fibrous stock suspension.

Apparatus 9 for adjustable/controllable dosing of fluid 10 (arrow) in partial fluid streams 10.T (arrow) into fibrous stock suspension 2 is in the embodiment of dosing sword 9.1 and includes five dosing channels 21 each provided respectively with dosing channel opening 21.1 and discharging at different levels and which are connected with common supply channel 22. Dosing channels 21 of apparatus 9 for adjustable/controllable dosing in the embodiment of dosing sword 9.1 which discharge at different height levels are located at equal distances a, and common supply channel 22 of apparatus 9 for adjustable/controllable dosing has circular cross sectional area 22.Q with diameter 22.D of 6 to 20 mm, for example 10 to 15 mm. Dosing channel 21 of apparatus 9 for adjustable/controllable dosing which is connected with common supply channel 22 has circular cross sectional area 21.Q with diameter 21.D of 2 to 10 mm, for example 4 to 6 mm.

Apparatus 9 in the embodiment of dosing sword 9.1 for adjustable/controllable dosing has length 9.L in the range of approximately 60 to 350 mm, for example 100 to 250 mm and, depending upon the height of the intermediate chamber of headbox 1, has height 9.H in the range of approximately 50 to 300 mm, for example 75 to 250 mm. Apparatuses 9, 9.1 for adjustable/controllable dosing may have uniform partition T (arrow) in the width direction of headbox 1 in the range of approximately 10 to 100 mm, or, for example, 25, 33, 50 or 66 mm (also compare FIGS. 2 and 3).

Dosing sword 9.1 is described and illustrated in the German patent application (Applicant File: HPA14265 DE and Applicant-Title: "MJ II-DoS-TE-Geometry") with same application date as the current patent application. The relating disclosure content is herewith made to the subject matter of the current description.

The characteristics of the embodiments of respective headbox 1 of the present invention, described in FIGS. 1 through 4 may be combined, at least partially. Respective headbox 1 illustrated in FIGS. 1 through 4 is well suited for utilization in a machine to produce fibrous web 3, in particular a paper or cardboard web from at least one fibrous stock suspension 2.

Fluid 10 flowing through the respective headbox 1 illustrated in FIGS. 1 through 4 includes at least water, for example white water or clarified water, or at least one fibrous stock suspension whose concentration is different than the average concentration of at least one fibrous stock suspension 2 flowing through headbox 1.

Advantageously, the headbox of the present invention provides a trouble free operation, even with a low pressure loss in the at least one fibrous stock suspension. Moreover, a process which is technologically sufficient and operationally stable is achieved over an expanded operational range while still providing a compact construction of the headbox.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Component Identification

1 Headbox
2 Fibrous stock suspension
3 Fibrous web
4 Feed device
5 Cross distribution pipe
6 Perforated distributor pipe plate
6.B Width (double arrow)
6.H Height
6.F Downstream total area
6.L Length (arrow)
6.O Open area
7 Channel
7.D Channel diameter
7.DM Middle channel diameter
7.F Downstream total area
7.Q Channel cross section
8 Intermediate channel
9 Apparatus for adjustable/controllable dosing of a fluid
9.1 Dosing sword
9.H Height
9.L Length
10 Fluid
10.T Partial fluid stream (arrow)
11 Turbulence generator
12 Flow channel
13 Chamber
14 Headbox nozzle
15 Nozzle gap
16 Aperture
17 Rapid expansion
17.1 Step expansion
17.2 Step expansion
18 Inlet chamfer
19 Continuous expansion
19.1 Cone
20 Diffuser
21 Dosing channel
21.1 Dosing channel opening
21.D Diameter
21.Q Cross sectional area
22 Supply channel
22.D Diameter
22.Q Cross sectional area
A View arrow
a Distance
B Width (arrow)
LG Total length
S Column
S1 Column
S2 Column
S3 Column
S4 Column
T Partition
TF Partition area
v.4 Flow speed
v.7 Flow speed
Z Row
Z1 Row
Z2 Row
Z3 Row
Z4 Row
Z5 Row
$\alpha$ cone angle

What is claimed is:

1. A headbox for a machine for producing a fibrous web, the fibrous web being a paper cardboard web, from at least one fibrous stock suspension, the head box comprising:

a feed device for feeding at least one fibrous stock suspension;

a perforated distribution pipe plate arranged immediately downstream from said feed device and having a first set of channels arranged in a first set of rows and columns, said perforated distribution pipe plate having a length $\geqq 0.5\cdot\sqrt{\text{partition}}$ area, said partition area being a ratio of a downstream total area of said perforated distribution pipe plate and a total number of said first set of channels of said perforated distribution pipe plate, said first set of channels arranged in said first set of rows and columns of said perforated distribution pipe include a diffuser at least in some areas of said first set of channels;

an intermediate channel arranged downstream from said perforated distribution pipe and extending over a width of the headbox, said intermediate channel including a plurality of apparatuses for dosing a fluid in a plurality of partial fluid streams into the at least one fibrous stock suspension, the apparatuses being spaced apart from each other in a width direction of the headbox, said apparatuses each having a plurality of dosing channels having a respective dosing channel opening and discharging at a plurality of different levels, said plurality of dosing channels being connected to a common supply channel;

a turbulence generator arranged downstream from said feed device, said turbulence generator having a second set of flow channels arranged in a second set of rows and columns; and a headbox nozzle directly contiguous with said turbulence generator, said headbox nozzle having a nozzle gap.

2. The headbox according to claim 1, wherein said apparatuses for dosing said fluid in said plurality of partial fluid streams into the at least one fibrous stock suspension being at least one of adjustable and controllable.

3. The headbox according to claim 2, wherein said partition area of said perforated distributor pipe plate assumes a value in a range of $\leqq$4,000 square millimeters ($mm^2$).

4. The headbox according to claim 3, wherein said partition area of said perforated distributor pipe plate assumes a value in a range of $\leqq$2,500 $mm^2$.

5. The headbox according to claim 4, wherein said partition area of said perforated distributor pipe plate assumes a value in a range between approximately 200 to 1,000 $mm^2$.

6. The headbox according to claim 5, wherein said perforated distributor pipe plate has an open area of $\geqq$30%, said open area being a ratio of a total downstream area of said first set of channels and a downstream total area of said perforated distributor pipe plate.

7. The headbox according to claim 6, wherein said open area of said perforated distributor pipe plate is $\geqq$40%.

8. The headbox according to claim 7, wherein said open area of said perforated distributor pipe plate is $\geqq$50%.

9. The headbox according to claim 8, wherein one of said plurality of channels of said perforated distributor pipe plate has a round channel cross section with a channel diameter including a middle channel diameter, said middle channel diameter and said distributor pipe plate length are in a ratio in a range of 1:2 to 1:10.

10. The headbox according to claim 9, wherein said middle channel diameter and said length of said distributor pipe plate are in a ratio in a range of 1:3 to 1:8.

11. The headbox according to claim 10, wherein said middle channel diameter and said length of said distributor pipe plate are in a ratio in a range of 1:4 to 1:5.

12. The headbox according to claim 1, wherein said diffuser has at least one rapid expansion.

13. The headbox according to claim 12, wherein said diffuser has a step expansion.

14. The headbox according to claim 13, wherein said diffuser has at least in some areas a continuous expansion.

15. The headbox according to claim 14, wherein said continuous expansion is a cone having a cone angle ($\alpha$) of $\leqq 30°$.

16. The headbox according to claim 15, wherein said diffuser has at least two expansions.

17. The headbox according to claim 16, wherein the at least one fibrous stock suspension supplied to said feed device is fed exclusively to said first set of channels of said perforated distribution pipe arranged immediately downstream adjacent to said feed device.

18. The headbox according to claim 17, wherein said feed device is dimensioned for a first flow speed of the at least one fibrous stock suspension and said first set of channels of said perforated distribution pipe plate has a second medium flow speed, said first flow speed and said second medium flow speed being in a ratio of between 1:2 to 1:3.

19. The headbox according to claim 18, wherein said perforated distributor pipe plate and said intermediate channel have a total length of a maximum of 500 millimeters (mm).

20. The headbox according to claim 19, wherein said perforated distributor pipe plate and said intermediate channel have a total length of a maximum of 350 mm.

21. The headbox according to claim 20, wherein said perforated distributor pipe plate and said intermediate channel have a total length of a maximum of 250 mm.

22. The headbox according to claim 2, wherein said apparatus for at least one of adjustably and controllably dosing said fluid in said plurality of partial fluid streams into the at least one fibrous stock suspension is a dosing sword.

23. The headbox according to claim 22, wherein said dosing fluid includes at least water.

24. The headbox according to claim 23, wherein said dosing fluid is one of white water and clarified water.

25. The headbox according to claim 24, wherein said dosing fluid includes at least one second fibrous stock suspension having a concentration different than an average concentration of the at least one fibrous stock suspension flowing through the headbox.

26. A machine for producing a fibrous web, the fibrous web being one of a paper web and a cardboard web, the machine comprising:

a headbox comprising:

a feed device for feeding at least one fibrous stock suspension;

a perforated distribution pipe plate arranged immediately downstream from said feed device and having a first set of channels arranged in a first set of rows and columns, said perforated distribution pipe plate having a length $\geqq 0.5\cdot\sqrt{\text{partition}}$ area, said partition area being a ratio of a downstream total area of said perforated distribution pipe plate and a total number of said first set of channels of said perforated distribution pipe plate, said first set of channels arranged in said first set of rows and columns of said perforated distribution pipe include a diffuser at least in some areas of said first set of channels;

an intermediate channel arranged downstream from said perforated distribution pipe and extending over a width of the headbox, said intermediate channel including a plurality of apparatuses for dosing a fluid in a plurality of partial fluid streams into the at least one fibrous stock suspension, the apparatuses being spaced apart from each other in a width direction of the headbox, said apparatuses each having a plurality of dosing channels having a respective dosing channel opening and discharging at a plurality of different levels, said plurality of dosing channels being connected to a common supply channel;

a turbulence generator arranged downstream from said feed device, said turbulence generator having a second set of flow channels arranged in a second set of rows and columns; and a headbox nozzle directly contiguous with said turbulence generator, said headbox nozzle having a nozzle gap.

* * * * *